US007779849B2

(12) United States Patent
Labarbera

(10) Patent No.: US 7,779,849 B2
(45) Date of Patent: Aug. 24, 2010

(54) UMBRELLA FEATURING A VERTICALLY DEPLOYABLE SUN SHADE

(76) Inventor: Salvatore J. Labarbera, P.O. Box 348, Sterling, VA (US) 20167

( * ) Notice: Subject to any disclaimer, the term of this patent is extended or adjusted under 35 U.S.C. 154(b) by 0 days.

(21) Appl. No.: 12/404,136

(22) Filed: Mar. 13, 2009

(65) Prior Publication Data

US 2009/0217957 A1 Sep. 3, 2009

Related U.S. Application Data

(63) Continuation-in-part of application No. 11/687,925, filed on Mar. 19, 2007, now Pat. No. 7,503,336.

(60) Provisional application No. 60/889,323, filed on Feb. 12, 2007.

(51) Int. Cl.
*A45B 15/00* (2006.01)
*E04H 15/28* (2006.01)

(52) U.S. Cl. ..... 135/16; 135/98; 135/33.41; 135/33.7; 160/24

(58) Field of Classification Search ..... 135/96, 135/98, 115, 117, 119, 16, 21, 31, 33.2–33.41, 135/33.7; 211/197, 204, 86.01, 94.01–94.03; 160/23.1, 24, 58.1
See application file for complete search history.

(56) References Cited

U.S. PATENT DOCUMENTS 1,072,340 A * 9/1913 Liljegran ..... 47/23.2
2,859,756 A * 11/1958 Barnes ..... 135/88.07
3,101,731 A * 8/1963 Stiglin ..... 135/143
3,151,621 A * 10/1964 Jackson ..... 135/16
3,194,409 A * 7/1965 Midouhas ..... 211/197
5,098,149 A * 3/1992 Lee ..... 296/97.6
5,174,073 A * 12/1992 Sabo ..... 52/3
5,806,547 A * 9/1998 Derlinga ..... 135/33.2
5,921,609 A * 7/1999 Mills et al. ..... 296/138
6,732,753 B2 * 5/2004 Chang ..... 135/20.3
7,581,555 B2 * 9/2009 McCullough ..... 135/33.2
2003/0037812 A1 * 2/2003 Stewart et al. ..... 135/96
2005/0215147 A1 * 9/2005 Masters et al. ..... 442/59

FOREIGN PATENT DOCUMENTS

DE 3702953 A1 * 8/1988
DE 4037087 A1 * 5/1992
DE 19705572 A1 * 8/1998
FR 2809437 A1 * 11/2001
GB 2038620 A * 7/1980
JP 2003159108 A * 6/2003
JP 2005089643 A * 4/2005

* cited by examiner

*Primary Examiner*—Winnie Yip
(74) *Attorney, Agent, or Firm*—Rossi, Kimms & McDowell LLP

(57) ABSTRACT

The invention adds one or more vertically-deployable sun shades to an umbrella for selectively providing shade for one or more users of an umbrella. More specifically, the sun shade resembles a conventional shade or set of blinds for covering a window. The size, shape, materials, and arrangement of the sun shade can vary according to user preferences or the intended manner or place of use.

2 Claims, 14 Drawing Sheets

UMBRELLA FEATURING A VERTICALLY DEPLOYABLE SUN SHADE

CROSS-REFERENCE TO RELATED APPLICATION

This application is a Continuation-in-Part application of and claimed priority from U.S. patent application Ser. No. 11/687,925 filed on Mar. 19, 2007, now U.S. Pat. No. 7,503,336, which in turn is based on and claims priority from U.S. Provisional Application Ser. No. 60/889,323, filed on Feb. 12, 2007.

BACKGROUND OF THE INVENTION

The present invention relates in general to umbrellas for providing protection from the elements. More specifically, the invention is directed to one or more sun shades which vertically deploy from an umbrella in order to selectively create shade for one or more users of the umbrella.

Umbrellas and similar protective coverings are commonly used at beaches, on patios, and in other settings in order to block sunlight or light emitted from another source in order to improve the comfort of one or more users of the umbrella. Such umbrellas provide diminishing utility to their users, however, if the sun or other light source changes its position relative to the placement of the umbrella, such that the light rays emitted therefrom are not satisfactorily blocked by the umbrella. Further, there also arises a similar problem with rain or other weather conditions, whereby changing weather conditions diminish the utility of the umbrella in a similar manner.

While tilting or otherwise changing the position of the umbrella might improve the comfort of some users of the umbrella, there arises the problem that this tilting or change of position negatively affects the comfort of other users of the umbrella. In other words, while it may be possible to reposition the umbrella to place one user in the shade, the relocation similarly places another in the sun. U.S. Pat. No. 6,328,047, for example, discloses a position adjustment member for an umbrella. The adjustment member allows the umbrella to tilt and rotate to a number of different positions. The position adjustment member, however, succumbs to the problem outlined above.

In view of the above, it would be desirable to provide an umbrella which features a mechanism for selectively providing shade for one or more users of an umbrella, that improves the comfort of one or more users of the umbrella without affecting the comfort of other users of the umbrella.

SUMMARY OF THE INVENTION

The invention provides one or more vertically-deployable sun shades for selectively providing shade for one or more users of an umbrella. More specifically, such a sun shade resembles a conventional shade or set of blinds for covering a window. The size, shape, materials, and arrangement of the vertically-deployable sun shade can vary according to user preferences or the intended manner or place of use. As one example, the sun shade can be made of a transparent or semi-transparent material embedded with or otherwise made of an anti-ultraviolet light chemical. In another example, the sun shade can be made of conventional cloth. It should be readily understood that components of the vertically-deployable sun shade can be made variously of metal, wood, plastic, and the like. Further, it should be understood that the umbrella can be of all shapes and sizes, can be made of any material, and can adhere to any number of configurations, alignments, and specifications.

It is well known that an umbrella is comprised of a rod which supports an umbrella canopy. Preferably, the vertically-deployable sun shade is an integral part of the umbrella and resides underneath one or more panels of the umbrella canopy. In this embodiment, the sun shade can be a permanent part of the umbrella or can be attached to and removed from the umbrella according to user preference. In one preferred embodiment, the vertically-deployable sun shade is permanently affixed to the rib of the umbrella by an attachment portion, which allows the sun shade to pivot and align itself generally parallel or adjacent to the rib. In another preferred embodiment, the attachment portion is designed to pivot in the middle so that two sun shade portions fold up within one panel of the umbrella in an inverted "V" configuration. In the case where the sun shade is not a permanent part of the umbrella, the sun shade is attached to the umbrella by an attachment portion. The attachment portion can comprise a clip, Velcro (Reg. Trademark of Velcro Industries B.V.), a snap fastener or any other mechanical attachment device sufficient to attach the sun shade to the umbrella. It should be readily apparent that, in some cases, the attachment portion of the vertically-deployable sun shade may require a complementary device on the umbrella, such as with the use of Velcro or a snap fastener.

Regardless of whether or not the sun shade is an integral part of the umbrella, the sun shade, in one embodiment, preferably deploys from a conventional window shade roller. Alternatively, the sun shade is rolled up or folded and contained by a sun shade containment portion. A sun shade containment portion might be comprised of a tie, bin, or other device that compactly contains the sun shade. Further, the sun shade containment portion might be an integral part of the umbrella or the sun shade. It should be readily understood that other arrangements are possible, including the use of a conventional set of window blinds.

In another embodiment of the invention, an umbrella including a plurality of vertically-deployable sun shades, as described above, can include an additional plurality of attachment portions for attaching one of the plurality of sun shades to one or more of the other sun shades among the plurality of sun shades. Because of potential gaps between each of the plurality of sun shades, it should be understood that an attachment portion can include an additional strip to close the gap therebetween. In this case, the additional plurality of attachment portions, when fully utilized among the fully deployed plurality of sun shades, forms an enclosure for improving the comfort of users of the umbrella. In this embodiment, each sun shade of the plurality of sun shades is preferably made of a mosquito netting or similar material.

BRIEF DESCRIPTION OF THE DRAWINGS

A fuller understanding of the present invention will become apparent upon consideration of the following detailed description taken in connection with the accompanying drawings, wherein.

DETAILED DESCRIPTION OF THE PREFERRED EMBODIMENTS

Figure 1:
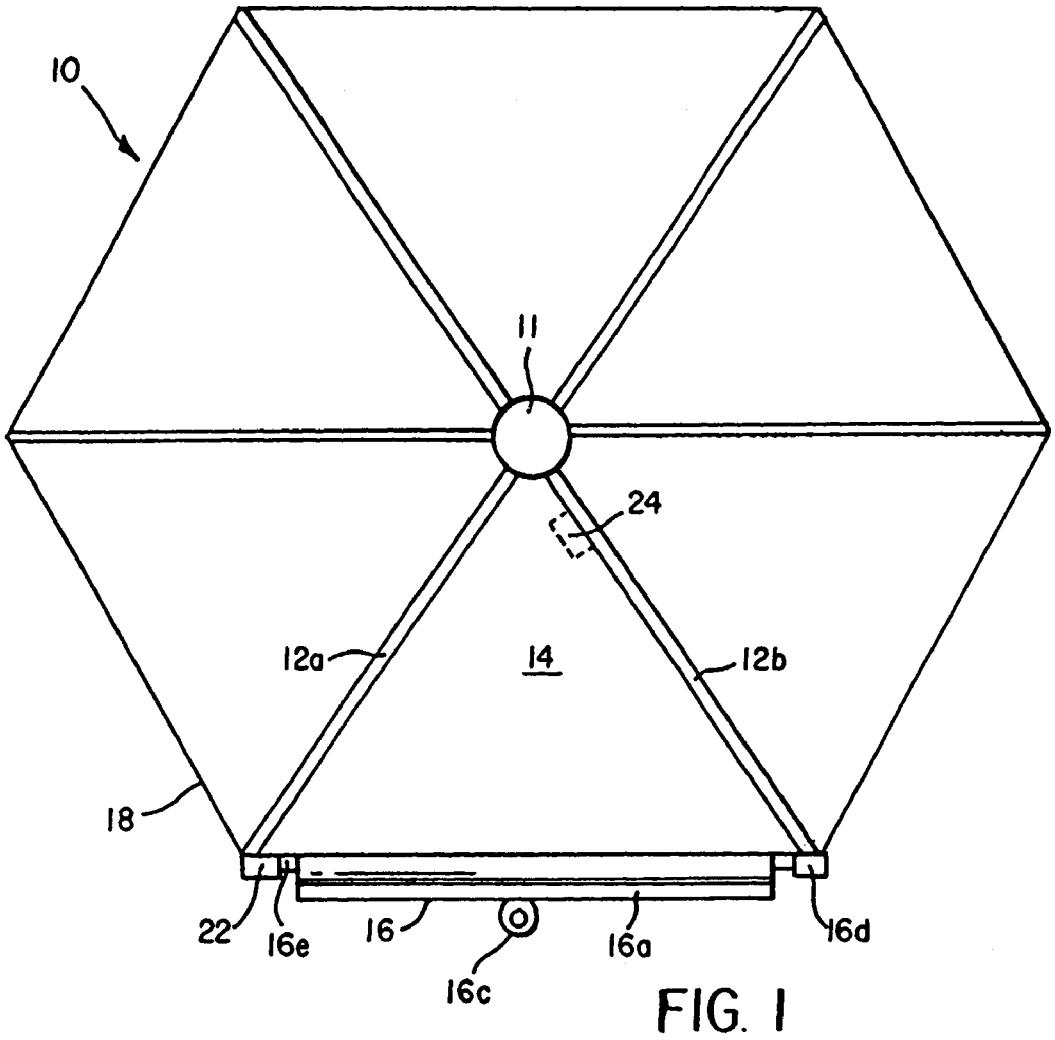
FIG. 1 is a top-down view of a panel of an umbrella canopy showing a vertically-deployable sun shade that is an integral part of an umbrella, wherein the umbrella canopy is opened.

A first embodiment of the present invention shall be discussed with reference to FIG. 1, which illustrates a top-down view of an umbrella and its umbrella canopy 10. The umbrella canopy 10 includes ribs 12*a* and 12*b* for sustaining the structure of the umbrella canopy 10 when it is fully opened, a canopy covering including canopy panels 14 disposed between the ribs, and a vertically-deployable sun shade 16. In the present embodiment, the sun shade 16 resides underneath the panel 14. It should be understood that more than one vertically-deployable sun shade 16 may reside underneath any or all of the additional panels of the umbrella canopy 10.

Figure 2:
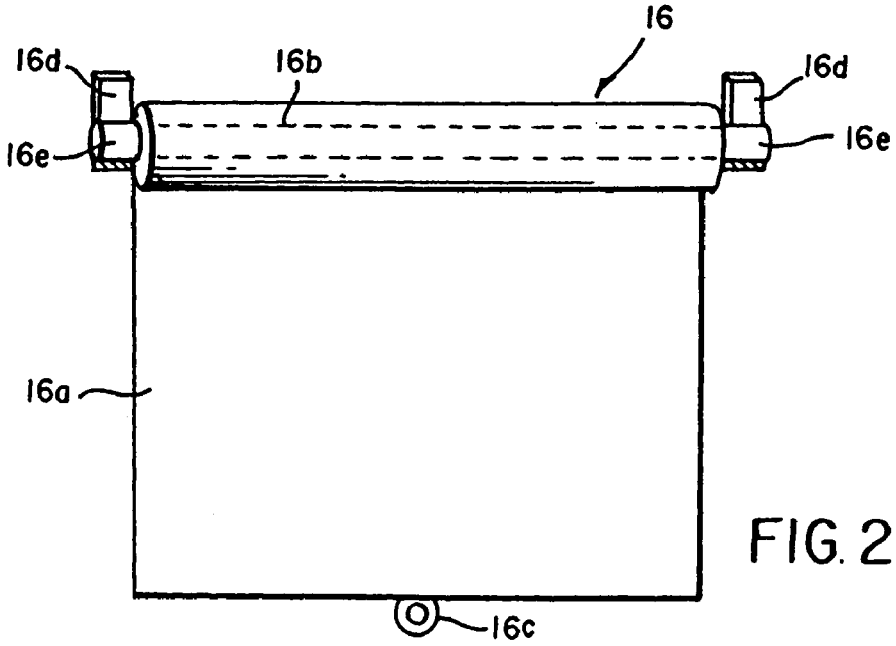
FIG. 2 is a perspective view of a vertically-deployable sun shade.
Figure 5:
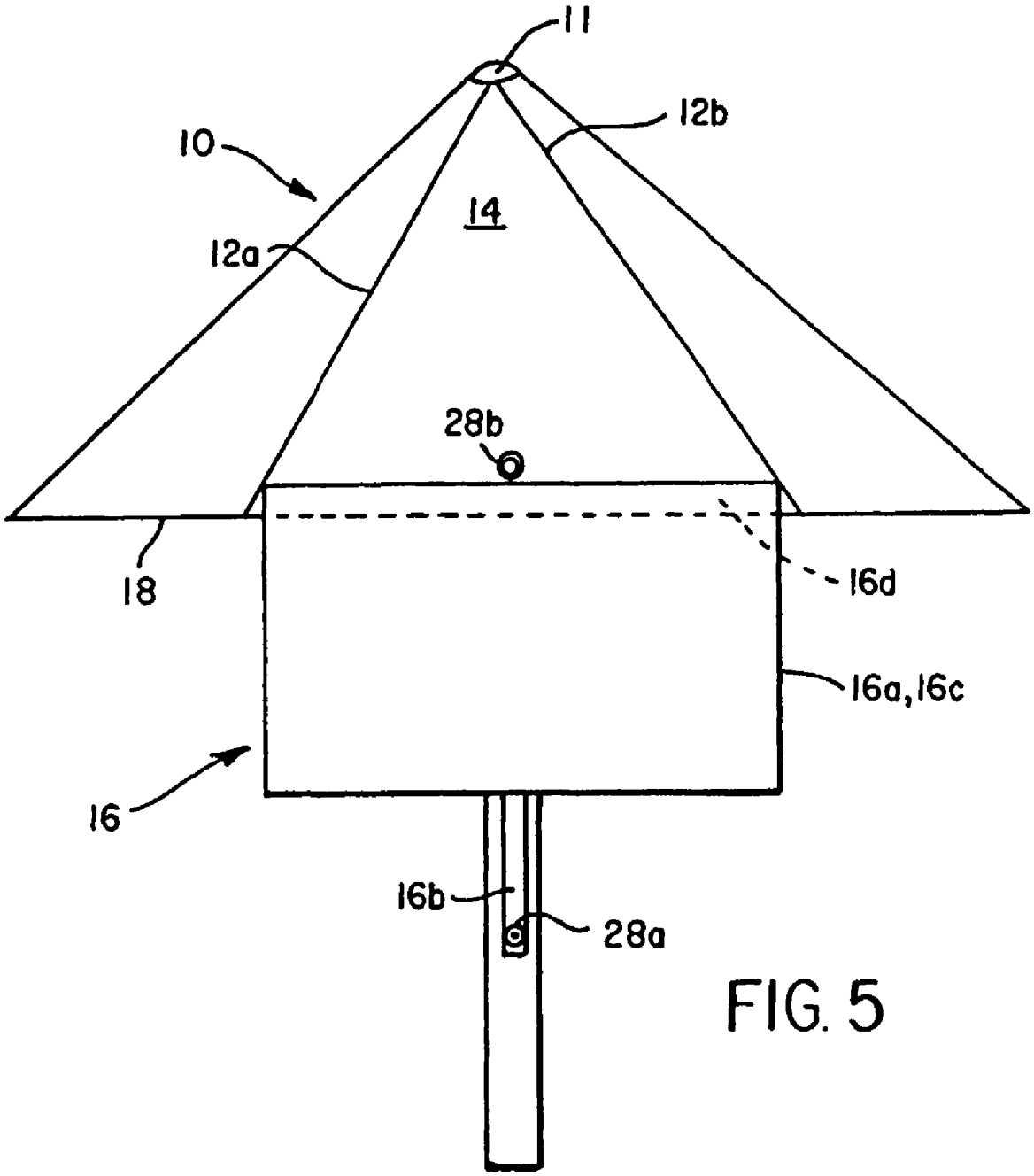
FIG. 5 illustrates an embodiment of the present invention wherein the vertically-deployable sun shade is an integral part of the umbrella canopy is discussed with reference to FIG. 5.

As shown in FIG. 2, the sun shade 16 includes a sun shade member 16*a*, which can be made of various materials as described above. As one example, the sun shade member 16*a* can be made of a transparent or semi-transparent material embedded with or otherwise made of an anti-ultraviolet light chemical. Alternatively, the sun shade member 16*a* can be made of cloth conventionally used in window coverings. One end of the sun shade member 16*a* is affixed in a conventional manner to a deployment portion 16*b* (shown in phantom.) In the illustrated example, the deployment portion 16*b* is a conventional spring-loaded window shade roller, and the sun shade member 16*a* is wrapped around the deployment portion 16*b* in a conventional manner. It should be understood that the roller shown is of a type used in conventional window coverings or the like. It should also be understood that the deployment portion 16*b* and the sun shade member 16*a* could also be of a type conventionally used with a set of Venetian blinds, mini-shades, honeycomb blinds, pleated shades or of another type entirely. When using such a sun shade member 16*a*, the sun shade 16 includes an appropriate blind support which functions as the sun shade deployment portion 16*b*. An activation portion 16*c*, shown in FIG. 2 as a ring, provides a user with the ability to activate or deploy shade member 16*a* from the deployment portion 16*b*. The activation portion 16*c* can vary depending on the nature of the deployment portion 16*b*, and may be an integral part of the sun shade member 16*a*. Specifically, the activation portion 16*c* may simply be an edge of the sun shade member 16*a*, as illustrated in FIG. 5. Further, it should be understood that the activation portion 16*c* can be comprised of a mechanized system for raising and lowering the sun shade member 16*a* by touch or remote control. FIG. 1 illustrates the vertically-deployable sun shade 16 as generally parallel to the umbrella canopy periphery 18 upon opening the umbrella by an umbrella activation member (not shown), such as a crank.

In one embodiment, the vertically-deployable sun shade 16 is permanently affixed to the rib 12*b* by an attachment portion 16*d*. In a preferred embodiment, the attachment portion 16*d* allows the sun shade 16 to pivot and align itself generally parallel or adjacent to the rib 12*b*. Immediately prior to closing the umbrella canopy 10 by use of the umbrella activation member, it is required that a user move the sun shade 16 toward the rib 12*b* such that the sun shade 16 lies generally parallel to the rib 12*b*. A receiving member 22 connected to the rib receives a protrusion 16*e* extending from the sun shade 16 such that the protrusion 16*e* snaps into the receiving member and is thus firmly held in place. Further, an additional receiving member 24 (shown in phantom) is preferably attached to the umbrella canopy periphery 18 and/or the rib 12*a* for securing the sun shade 16 when it is generally parallel to the umbrella canopy periphery 18. Alternatively, the protrusion 16*e* and the additional receiving member 24 can be removed and the attachment portion 16*d* can provide adequate strength to hold the sun shade 16 in a position generally parallel to the umbrella canopy periphery 18. Additionally, it should be noted that the umbrella canopy 10 includes an umbrella hub 11, as is typical of an umbrella.

Figure 3A:
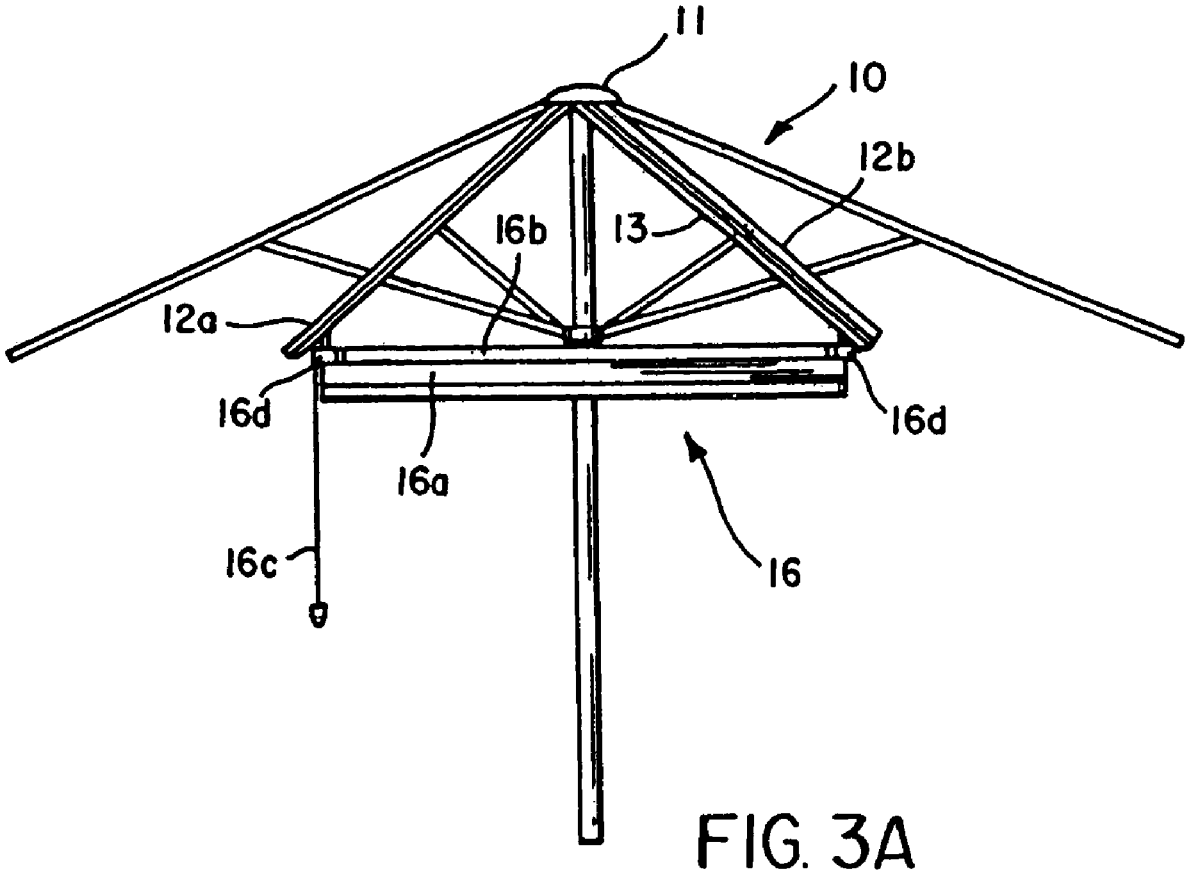
FIG. 3A is a perspective view of an umbrella canopy featuring a structure for automatically rotating a vertically-deployable sun shade that is an integral part of an umbrella.
Figure 3B:
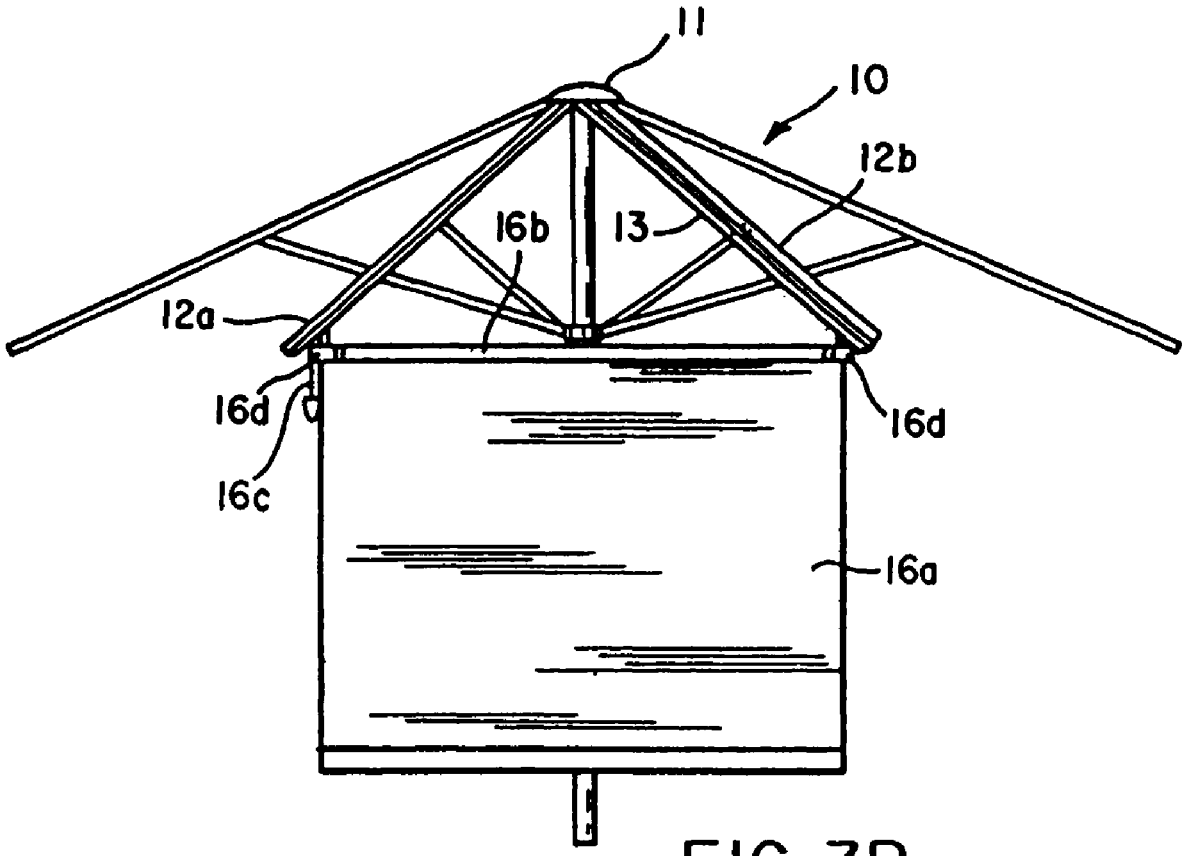
FIG. 3B is a perspective view of the umbrella of FIG. 3A with the vertically-deployable sun shade in the lowered state.
Figure 3C:
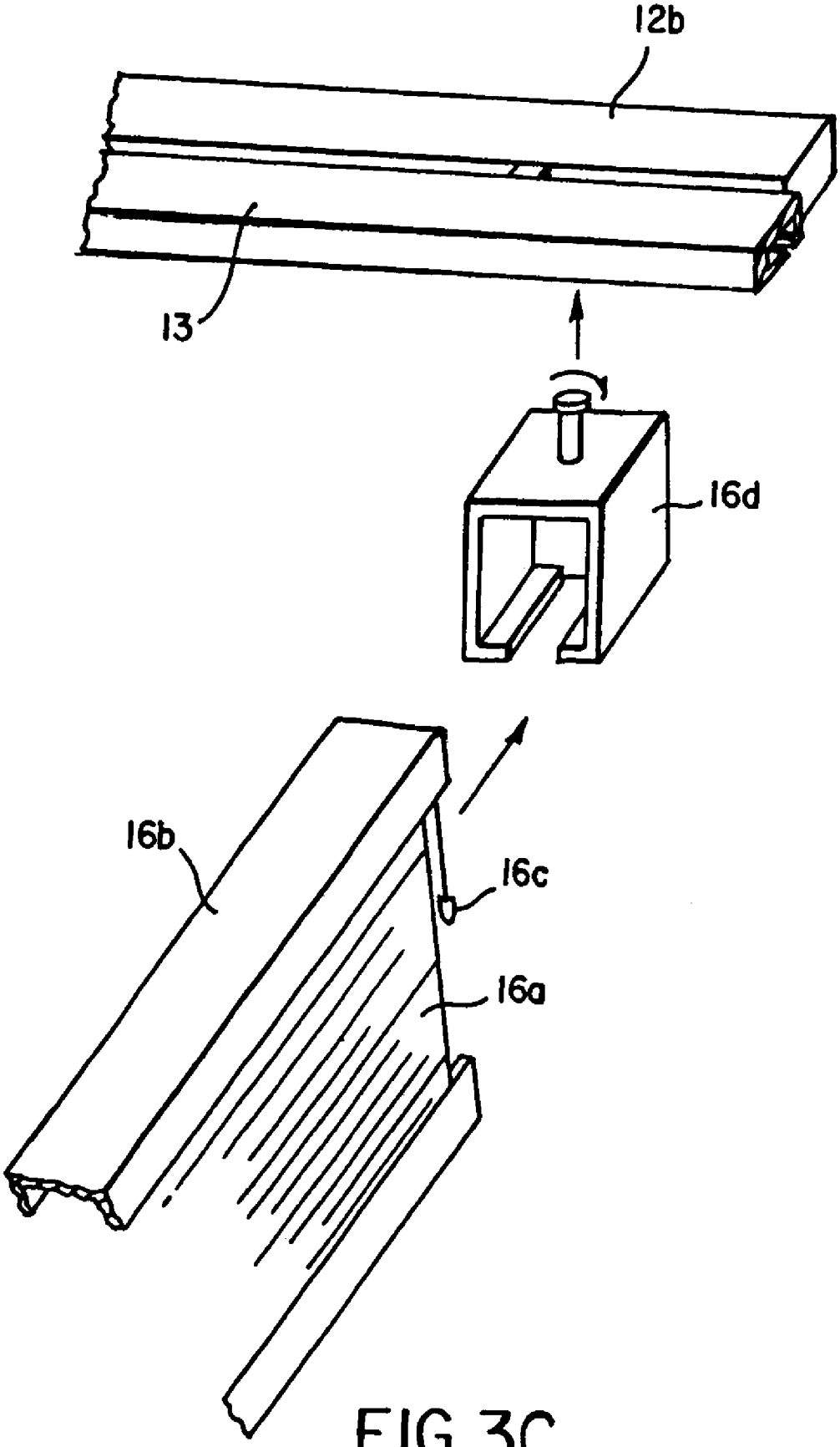
FIG. 3C is a perspective view of the structure for automatically rotating the vertically-deployable sun shade of FIG. 3A.
Figure 3D:
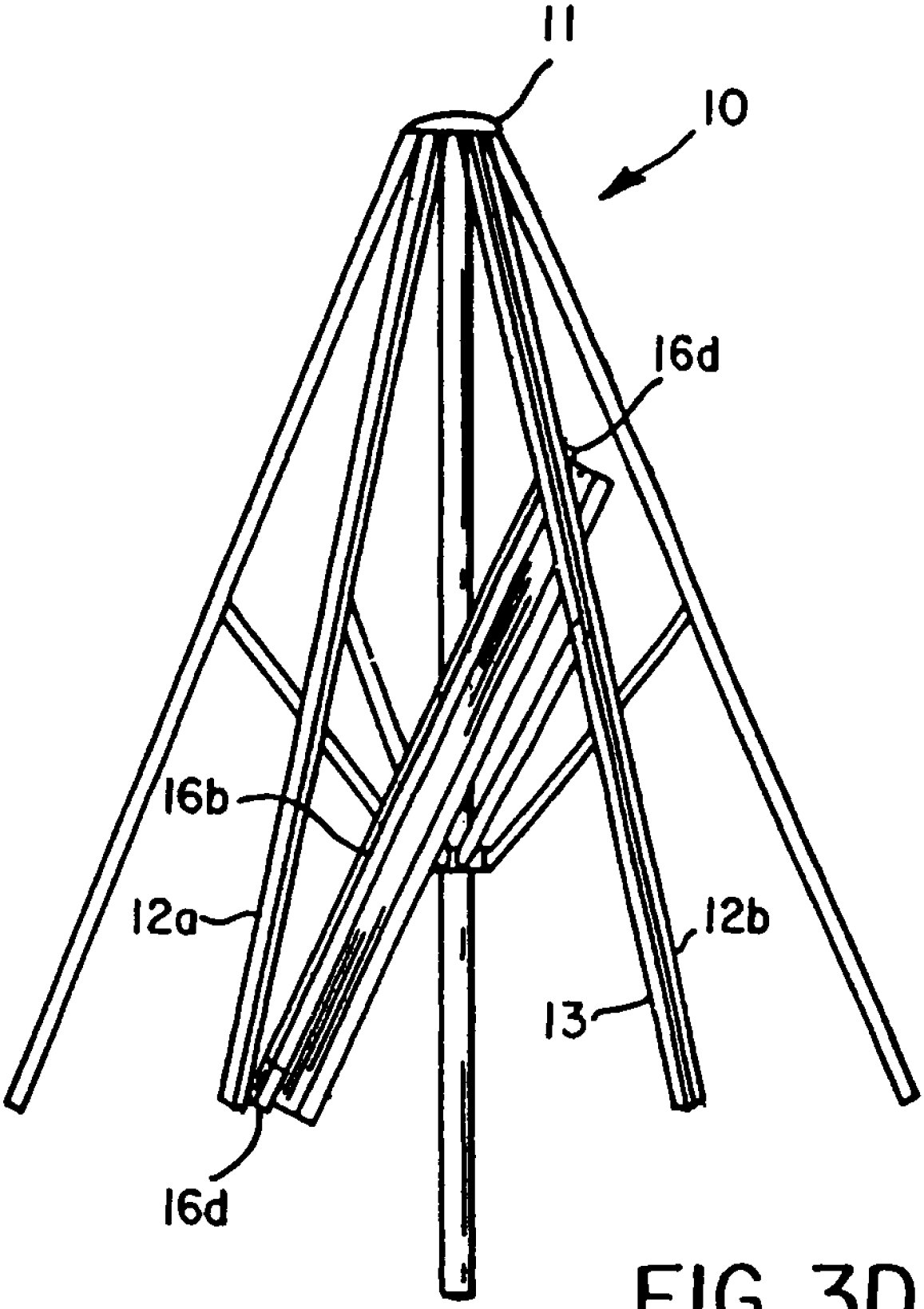
FIG. 3D is a perspective view of the umbrella of FIG. 3A wherein the umbrella canopy is partially closed.
Figure 3E:
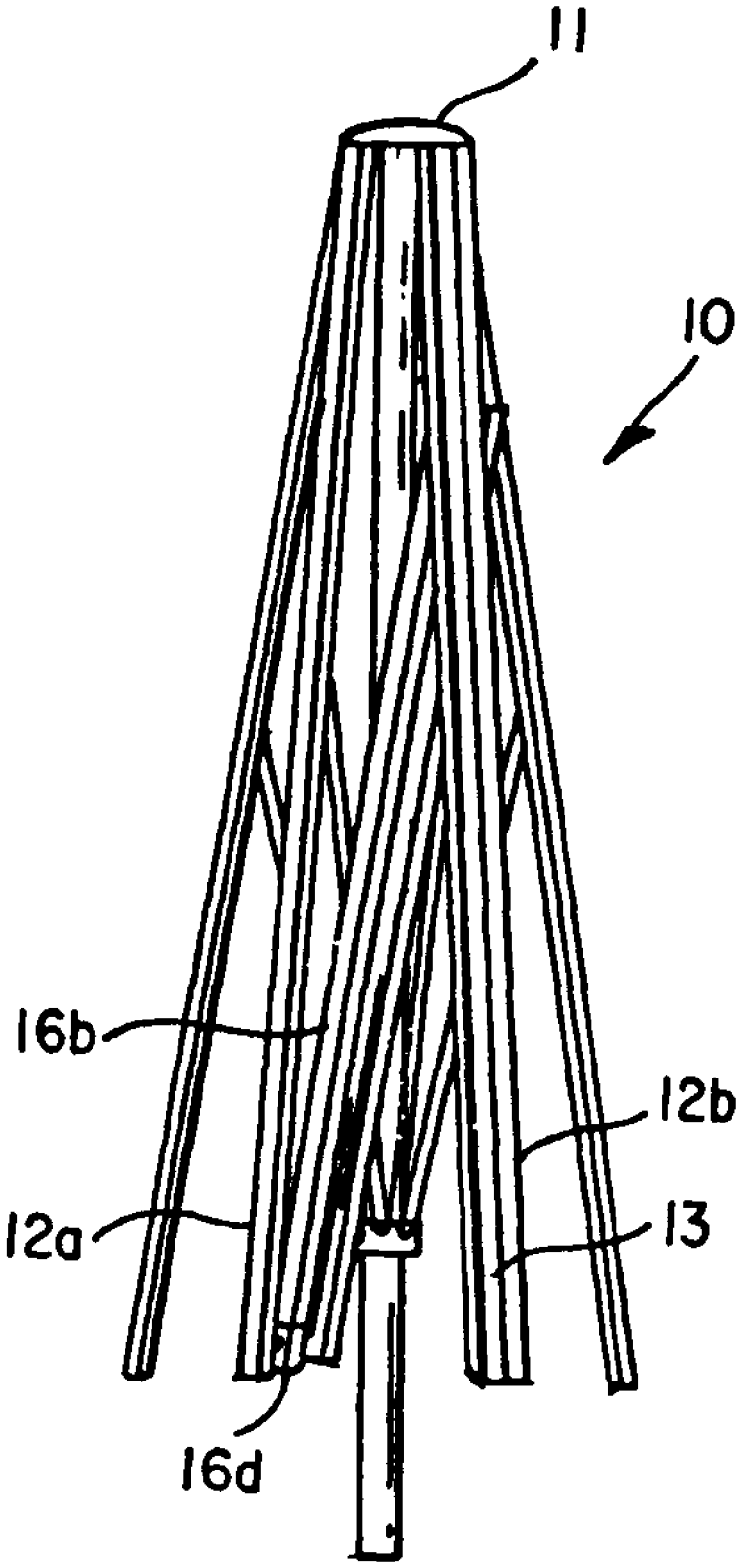
FIG. 3E is a perspective view of the umbrella of FIG. 3A wherein the umbrella canopy is fully closed.

FIGS. 3A through 3E illustrate an alternative embodiment which includes a structure for automatically rotating a vertically-deployable sun shade that is an integral part of an umbrella. For ease of illustration, FIGS. 3A through 3E show the umbrella canopy of the umbrella with the umbrella covering removed. Unlike FIG. 1, FIGS. 3A through 3E illustrate sun shade 16 as a pleated blind. Referring to FIG. 3A, the sun shade 16 attaches to the umbrella at each end by the attachment portions 16*d*, each comprised of a retaining bracket in the illustrated example. FIG. 3A illustrates a raised position for the sun shade member 16*a* and FIG. 3B shows a lowered position for the sun shade member 16*b*. Additionally, one of the attachment portions 16*d* at a first end of the sun shade 16 is set or moveably attached to a runner 13 that is affixed to the rib 12*b*. The runner 13 allows the first end of the vertically-deployable sun shade 16 to slide freely in a trajectory generally parallel to the rib 12*b*, and additionally, the attachment portion 16*d* at the second end of the sun shade 16 allows the second end of the sun shade 16 to rotate freely, such that as the umbrella is closed the sun shade 16 is rotated into a position substantially parallel to the ribs. The runner 13 and attachment portion 16*d* are more closely illustrated in FIG. 3C. The progressive closing of the umbrella canopy is shown in FIGS. 3D and 3E. Referring to FIG. 3C, the runner 13 includes a channel or groove by which the attachment portion 16*d* can be inserted into and allowed to move in a trajectory generally parallel to the rib 12*b*. It should be additionally noted that the runner 13 can be an integral part of the rib 12*b*.

With the vertically-deployable sun shade 16 disposed in this manner, the vertically-deployable sun shade 16 is able to collapse in tandem with the ribs of the umbrella canopy 10 as the umbrella canopy 10 is closed by the umbrella activation member (not shown.) A wire (not shown) embedded in or that runs generally parallel to the rib 12*b* provides the work necessary for this novel operability. One end of the wire is connected to the appropriate attachment portion 16*d*. The other end of the wire is attached to a cable (not shown) running from the umbrella activation member to the umbrella hub 11. This cable is disposed such that an activation of the umbrella activation member to close the umbrella canopy 10 increases tension in the cable, and an activation of the umbrella activation member to open the umbrella canopy 10 releases tension in the cable. Such a disposition causes the movement of one end of the vertically-deployable sun shade 16 along the runner 13 as the umbrella canopy is closed. As this occurs, each end of the vertically-deployable sun shade 16 rotates as necessary. FIGS. 3D and 3E illustrate this movement. Conversely, upon opening the umbrella canopy 10 by utilization of the umbrella activation member, the force of gravity provides for the opposite movement to occur due to a release of tension in the cable. Hence, in this embodiment, there is no need for a user to manually rotate the sun shade 16 upon opening or closing the umbrella canopy 10.

Figure 4:
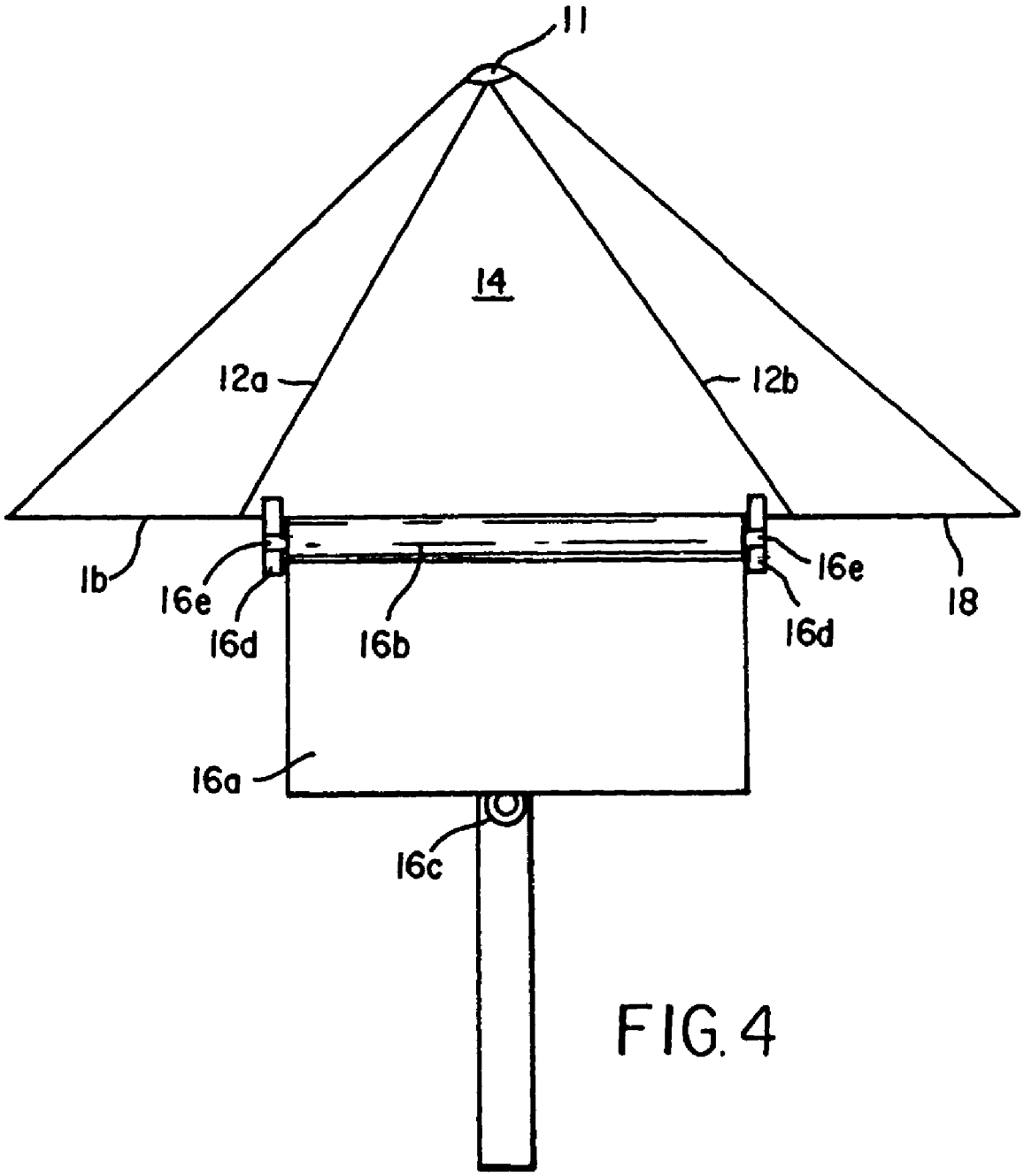
FIG. 4 is a side view of a vertically-deployable sun shade temporarily attached to an umbrella.

In another embodiment of the invention, a vertically-deployable sun shade is provided which can attach to an umbrella or another object. Referring again to FIG. 2, the attachment portions 16*d* comprise clips that allow the sun shade 16 to be clipped on to the umbrella canopy periphery 18. It should be understood that the clips resembling the operation and feel of a clothespin or similar device. It should be further understood that the clip can be made of many different materials, among them plastic and metal. Of course, other devices can be used for the attachment portion 16*d* that permit the sun shade 16 to be easily attached and detached from the umbrella canopy. FIG. 4 illustrates the vertically-deployable sun shade 16 with clip type attachment portions 16*d*.

Another embodiment of the present invention wherein the vertically-deployable sun shade is an integral part of the umbrella canopy is discussed with reference to FIG. 5. FIG. 5 shows a front view of an umbrella wherein the vertically-deployable sun shade 16 is attached to the panel 14 at the attachment portion 16*d* utilizing conventional materials and methods. In the illustrated embodiment, an activation portion 16*b* is comprised of a tie, or long piece of material, including a snap fastener 28*a*. A complementary portion 28*b* to the snap fastener is conventionally affixed to the panel 14. It should be readily understood that the activation portion 16*b* could instead include Velcro, a clip, or some other means for fastening the activation portion 16*b* to the umbrella canopy 10 in order to contain the sun shade member 16*a*. It should be noted that in this embodiment the activation portion 16*b* also constitutes a containment portion for containing the vertically-deployable sun shade 16 in order to compactly store the vertically-deployable sun shade 16. It should be further noted that in this particular illustrated case the deployment portion 16*b* and the sun shade member 16*a* are the same thing, since an edge of the sun shade member 16*a* serves as the activation portion 16*c*.

Figure 6:
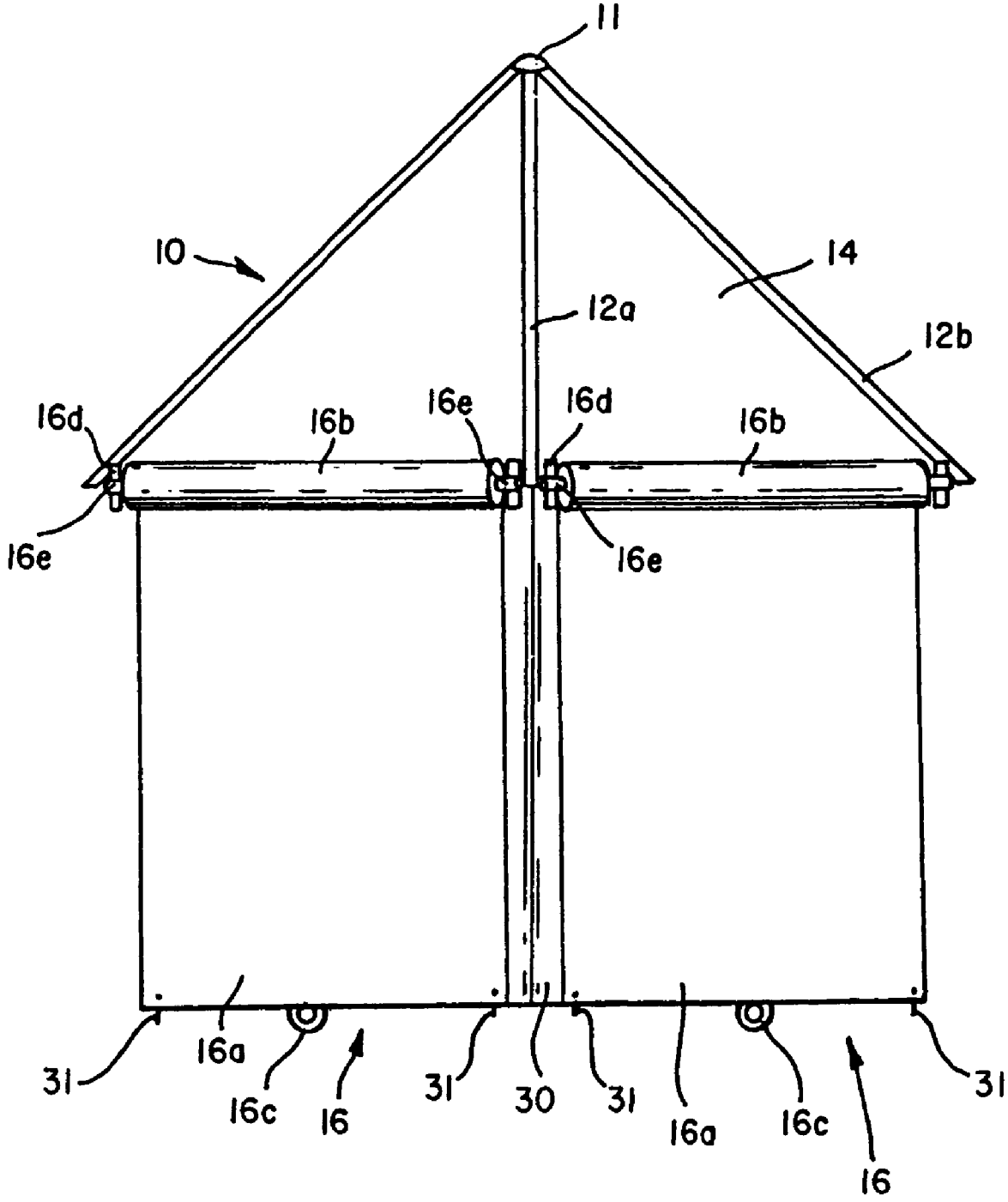
FIG. 6 is a perspective view of an enclosure formed from the attachment of each of a plurality of vertically-deployable sun shades included in an umbrella by utilizing a plurality of attachment strips to connect adjacent vertically-deployable sun shades among the plurality of vertically-deployable sun shades together.

Yet another embodiment of the present invention is illustrated in FIG. 6. The present embodiment provides for an enclosure, wherein the enclosure is formed by a plurality of the previously described vertically-deployable sun shades 16 either integrated into an umbrella or as a temporary part thereof. FIG. 6 illustrates the case where the sun shades 16 are not an integral part of the umbrella. In this embodiment, the aforementioned enclosure is formed from the attachment of each of the plurality of sun shades 16 to one another. Because a gap may occur between the vertically-deployable sun shades 16, an attachment strip 30 made of the same material as the sun shade member 16*a* can be utilized in order to fill such gaps. The attachment strip 30 should be made of the same material as the sun shade member 16*a*, although it can be made of a different material entirely. It should be understood that although the figure illustrates the use of temporary sun shades 16, the sun shades 16 could also be integrated into the umbrella canopy 10 as previously described. Each of the attachment strips 30 may be comprised of a snap fastener, a clip, Velcro, or other attachment devices. In the illustrated example, the attachment strips 30 comprise Velcro and the sun shades 16 include the complementary Velcro components necessary for such attachment (not shown.) It should also be noted that, preferably, the sun shade member 16*a* is made of mosquito netting or a transparent or semi-transparent material. Further, stakes 31 can be added to stake the sun shade portions to the ground.

Figure 7:
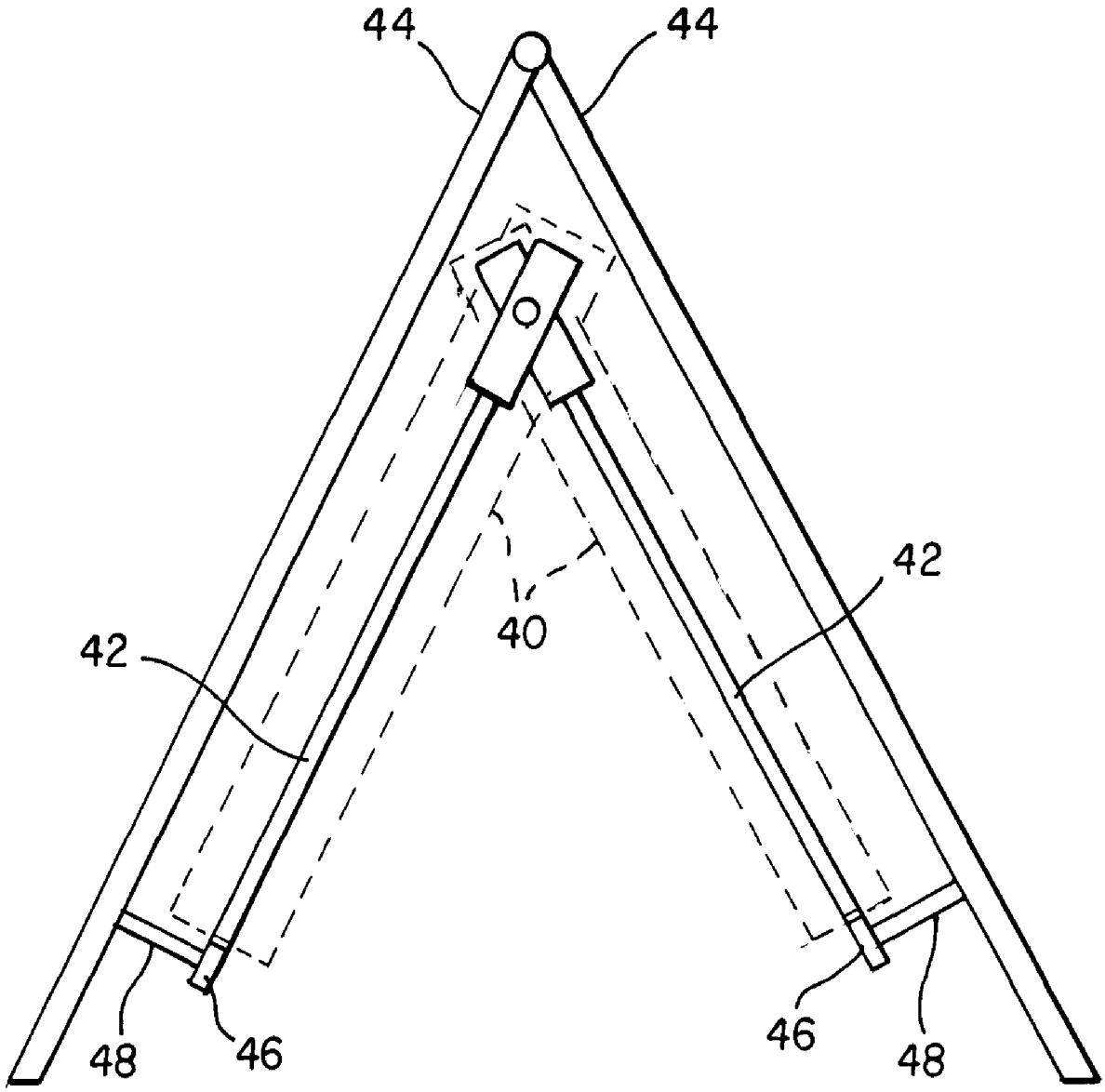
FIG. 7 illustrates a further embodiment of the invention in which a hinged deployment structure is utilized to deploy sun shade portions.
Figure 8:
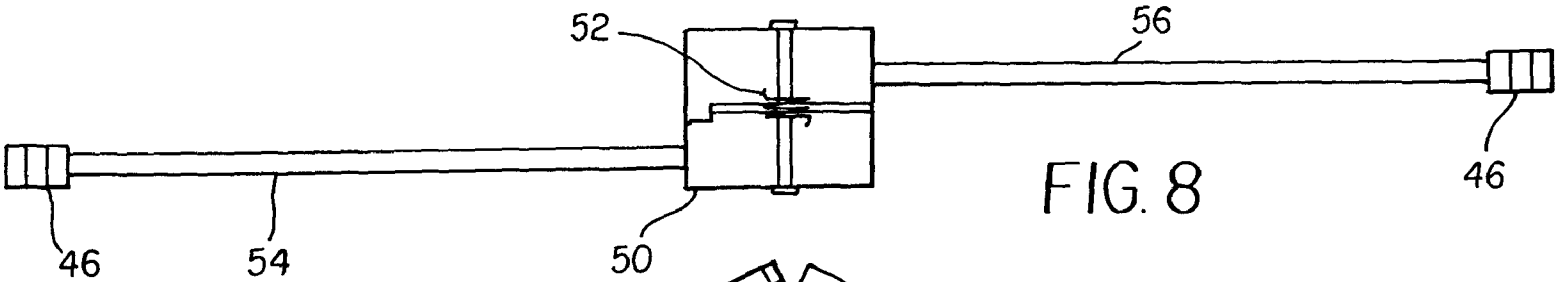
FIG. 8 is a top view of the hinged deployment structure illustrated in FIG. 7.
Figure 9:
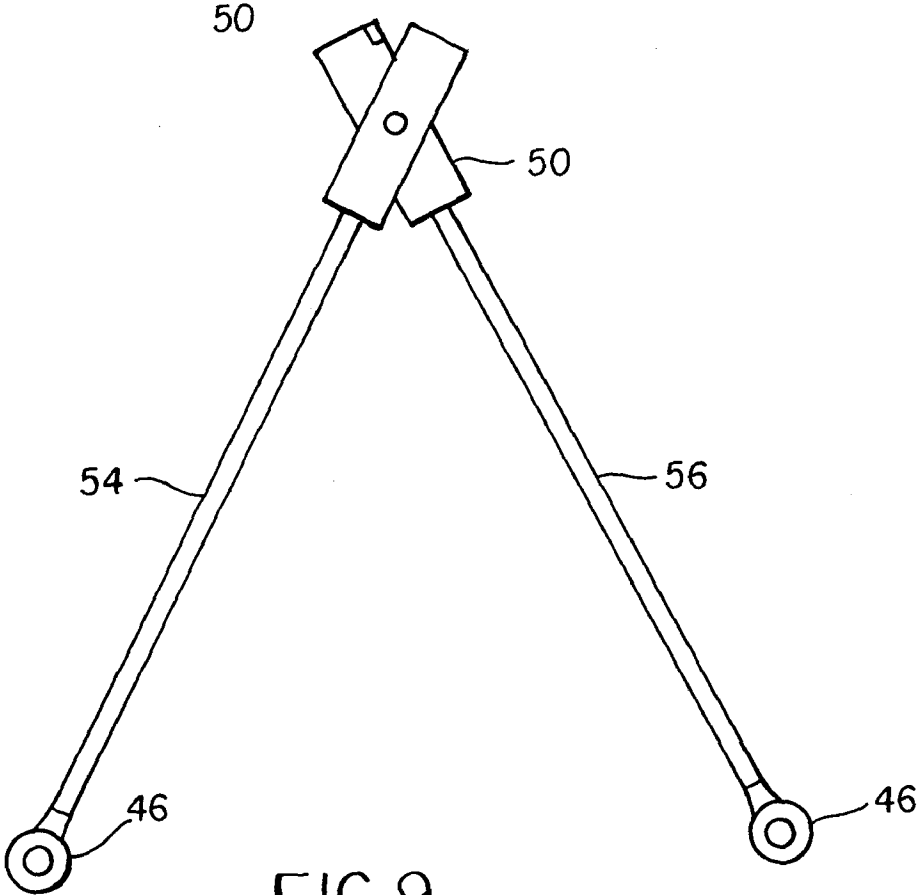
FIG. 9 is a side view of the hinged deployment structure illustrated in FIG. 7.

Another embodiment of the invention in which each sun shade folds up within the umbrella canopy in an inverted "V" shape is shown in FIG. 7. In this embodiment, the sun shade includes two sun shade portions 40 (indicated in phantom to allow underlying structure to be shown and each being the same in structure as the above described sun shade) are each mounted to a hinged member 42, which in turn is mounted to the umbrella ribs 44 via rod end couplings 46 that are attached to attachment points 48. The hinged member 42 acts as a deployment structure to deploy the sun shade portions 40 into a position in which the shades of the sun shade portions 40 can be vertically deployed. FIG. 8 illustrates the hinged member 42 in its full extended position when the umbrella canopy is up. FIG. 9 illustrates the hinged member 42 when the umbrella canopy is down. As shown in FIG. 8, the hinged member 42 preferably includes a central hinge 50 including an integral tension spring 52 that helps the rod to fold into an inverted "V" shape shown in FIG. 9 when the umbrella canopy is lowered down. The sun shade portions 40 are preferably mounted to provide overlap therebetween. For example, one sun shade portion 40 is preferably mounted to a front portion of one arm 54 of the hinged member 42, while a second sun shade portion 40 is mounted to a back portion of a second arm 56 of the hinged member 42. Accordingly, the sun shade portions 40 do not interfere with one another when the hinged member 42 is moved to the inverted "V" position, and are moved into positions that are generally parallel with a rib of the umbrella canopy when the umbrella canopy is closed. Other mounting positions are possible, for example, the sun shade portions 40 can be mounted below the first arm 54 and second arm 56. Still further, the sun shade portions 40 can be mounted such that they do not overlap, but this would be less desirable than an overlapping installation.

In the above embodiments, it should be understood that additional weight provided in the vertically-deployable sun shade might be useful in windy weather conditions. Therefore, the vertically-deployable sun shade of the above embodiments can additionally include a metal or otherwise appropriately heavy object in order to provide enhanced stability in windy weather conditions.

In conventional umbrellas, the canopy is deployed by rotating a crank mechanism that operates to wind a line around a spindle. The line is attached to hub that moves up and down the umbrella pole. The hub is connected to the canopy deployment structure. With the crank is turned, the line pulls the hub upward to open the canopy. When lowering the umbrella, however, such conventional crank mechanisms are not designed to apply a positive force to the line to pull the canopy closed and the force of gravity is primarily relied upon to close the canopy. In the above described embodiments in which the sun shades are pulled generally vertical upon closing the umbrella, however, it would be desirable to provide a positive force when closing the umbrella canopy to help in overcoming the additional frictional forces created by pulling the sun shades to the vertical position.

Figure 10:
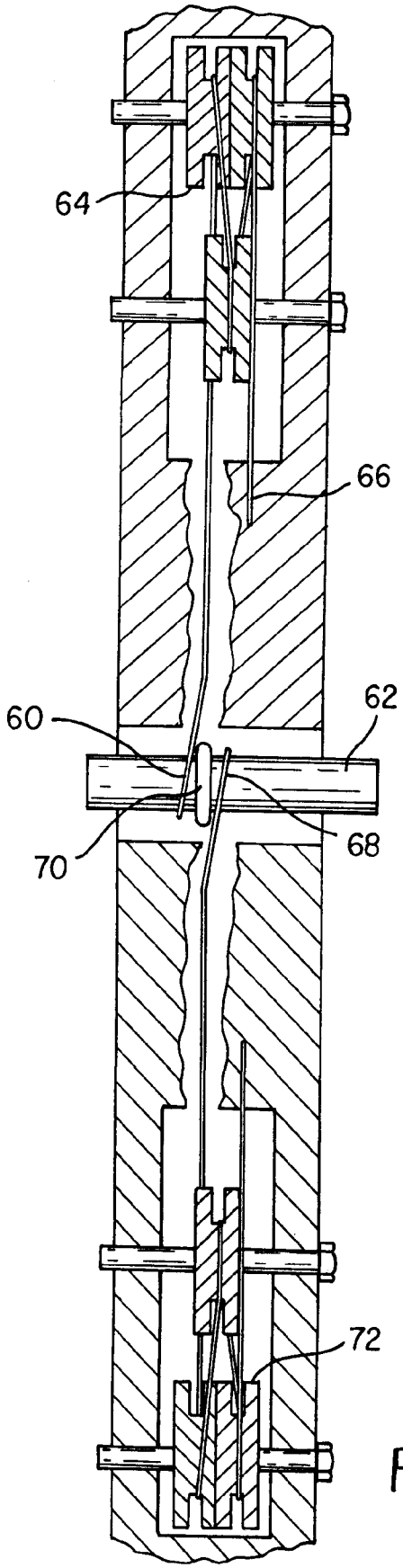
FIG. 10 is a schematic illustration of a bi-directional pulley system.
Figure 11:
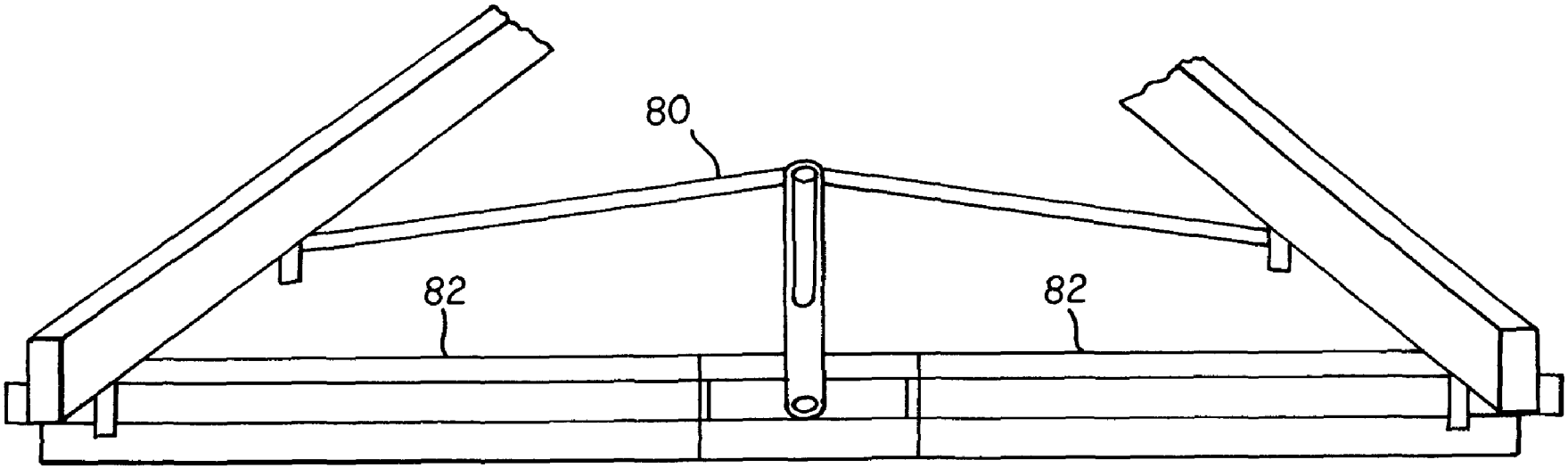
FIG. 11 illustrates a further embodiment of the invention utilizing a hinged deployment structure.
Figure 12:
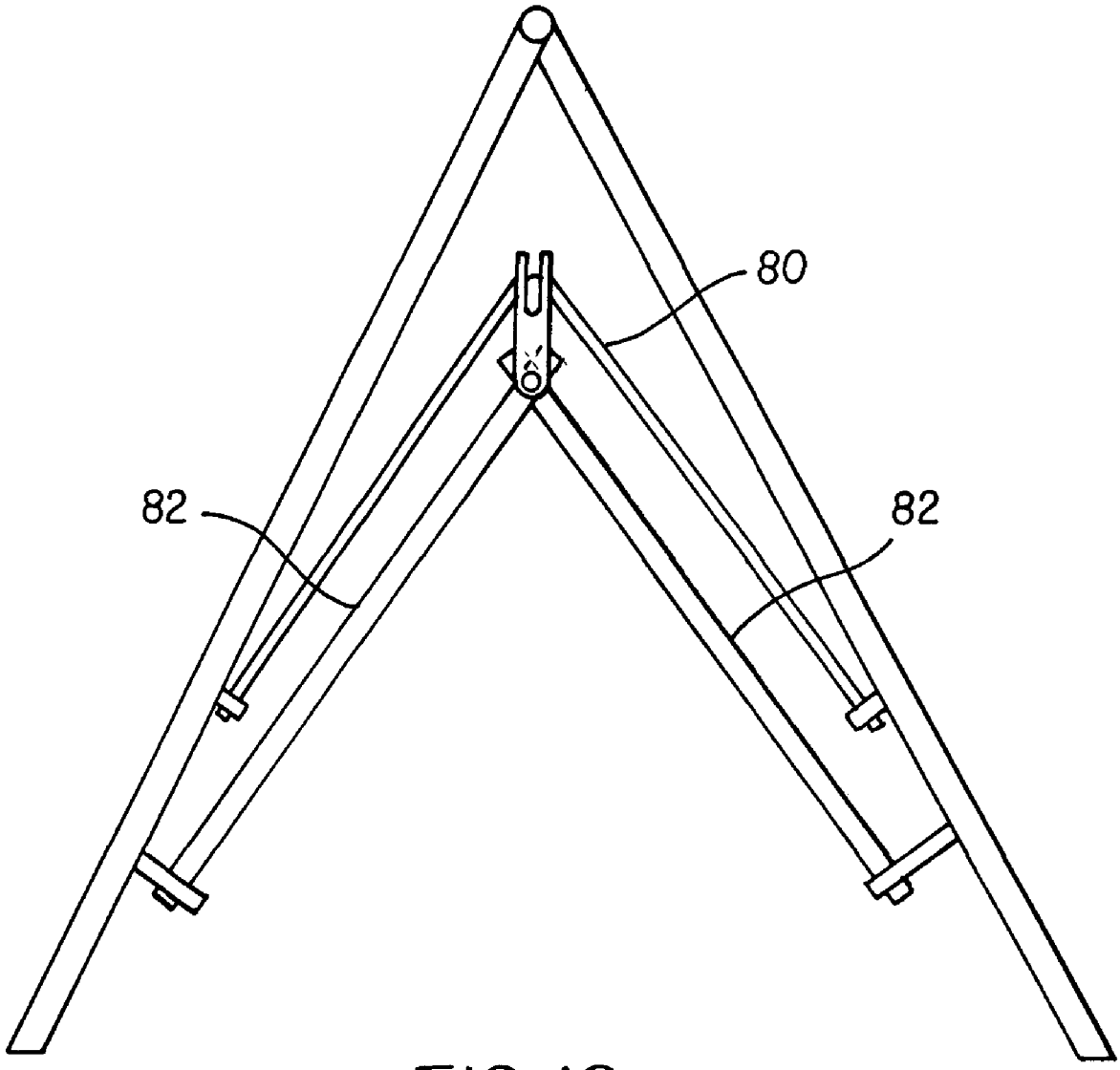
FIG. 12 illustrates the closure of an umbrella utilizing the hinged deployment structure of FIG. 11.

FIG. 10 illustrates a bi-direction pulley system that is preferably used to open and close an umbrella canopy. A first cable 60 is attached to a spindle 62 within the body of the umbrella pole, traverses through one or more upper pulleys 64, exits the pole at a location above the umbrella hub (now shown), and has an end 66 attached to the top the hub. When a crank attached to the spindle 62 is turned, the first cable 60 winds around the spindle 62 and pulls the hub up forcing the umbrella ribs and attached canopy to open. A second cable 68 is also attached to the spindle 64 on a side opposite to the first cable 60, and is preferably separated from the first cable 60 a divider 70 provided on the spindle 62. The second cable 68, traverses through one or more lower pulleys 72, exits the pole at a location below the umbrella hub and is attached to the bottom of the hub. When the crank is turned in the opposite direction, the second cable 68 is wound around the spindle 62 and applies a positive closing force to the hub through the lower pulleys 72. In other words, the two pulley systems are oppositely wound so that one applies a positive opening force and the other applies a positive closing force The invention has been described with reference to certain preferred embodiments thereof. It will be understood, however, that modifications and variations are possible within the scope of the appended claims. For example, while the invention has been described with reference to an umbrella, the invention is also applicable to other types of shades including awning canopy or a tent canopy, as just one example. Further, the invention is not limited to the specific mechanical structures illustrated in the preferred embodiments for folding the sun shades within in the canopy, but instead, is intended to cover any mechanical structure that accomplishes rotating the vertically-deployable sun shade or sun shade portions into a position generally parallel with a rib of the umbrella canopy when the umbrella canopy is closed. FIG. 11, for example, illustrates a further embodiment in which an actuating mechanism 80 is provided to pull sun shade portions 82 substantially vertical as shown in FIG. 12.

What is claimed is:

1. An umbrella comprising:

a canopy being supported by a plurality of ribs;

a pole supporting the canopy; and at least one vertically-deployable sun shade including at least two sun shade portions attached to the canopy via a hinged deployment structure;

wherein the deployment structure is pivotally attached between the ribs;

wherein the at least two sun shade portions are rotatably mounted on the deployment structure to be operated between a vertically-deployed position and closed position;

wherein the deployment structure attaches the least two sun shade portions generally parallel to a canopy periphery when the umbrella canopy is opened;

wherein the deployment structure rotates each of the sun shade potions generally parallel with the rib of the umbrella canopy when the umbrella canopy is closed; and wherein the deployment structure includes a hinged member that moves the deployment structure into an inverted "V" position when the umbrella canopy is closed.

2. An umbrella according to claim 1, wherein the umbrella is provided with a plurality of sun shades.

* * * * *